US007261214B2

(12) United States Patent
Wagner et al.

(10) Patent No.: US 7,261,214 B2
(45) Date of Patent: Aug. 28, 2007

(54) STORE LEAD-IN FIXTURE FOR A PRODUCT DUMP TABLE

(75) Inventors: Mark A. Wagner, Lake Forest, IL (US); Joseph Brahar, Wheeling, IL (US)

(73) Assignee: Walgreen Co., Deerfield, IL (US)

( * ) Notice: Subject to any disclaimer, the term of this patent is extended or adjusted under 35 U.S.C. 154(b) by 280 days.

(21) Appl. No.: 10/772,804

(22) Filed: Feb. 5, 2004

(65) Prior Publication Data

US 2005/0173359 A1 Aug. 11, 2005

(51) Int. Cl.
*A47F 8/08* (2006.01)

(52) U.S. Cl. ..... 211/90.02; 211/187; 211/103; 108/96; 108/147.11

(58) Field of Classification Search ..... 211/90.02, 211/134, 103, 187, 190, 207; 248/241, 242, 248/243; 108/42, 96, 106, 144.11, 147.11
See application file for complete search history.

(56) References Cited

U.S. PATENT DOCUMENTS 1,219,715 A * 3/1917 Eisman ..... 108/14
2,255,744 A * 9/1941 Loeb et al. ..... 312/234
3,471,978 A * 10/1969 Fenwick ..... 52/36.6
3,489,290 A * 1/1970 Larson ..... 211/190
3,556,306 A * 1/1971 Shell ..... 211/90.02
4,138,019 A * 2/1979 Smith ..... 211/87.01
5,611,442 A * 3/1997 Howard ..... 211/187
6,540,093 B1 * 4/2003 Shumway ..... 211/90.02
2002/0060198 A1 * 5/2002 Bustos ..... 211/187
2002/0073902 A1 * 6/2002 Jipp ..... 108/106
2003/0005863 A1 * 1/2003 Chen ..... 108/96
2003/0205545 A1 * 11/2003 Moceri ..... 211/90.02

* cited by examiner

*Primary Examiner*—Richard E. Chilcot, Jr.
*Assistant Examiner*—Lindsay M. Maguire
(74) *Attorney, Agent, or Firm*—Marshall, Gerstein & Borun LLP; Francis C. Kowalik

(57) ABSTRACT

For visually displaying product on the side wall of a product dump table, a store lead-in fixture includes a support structure, a mounting structure, and a presentation structure. The support structure is to be placed in confronting relation to the side wall of the product dump table. The mounting structure is to be placed in operative association with the top edge of the product dump table. The presentation structure is for visually displaying product on the side wall of the product dump table. With this arrangement, the presentation structure may comprise one or more product display shelves and/or one or more product hanging projections.

13 Claims, 3 Drawing Sheets

STORE LEAD-IN FIXTURE FOR A PRODUCT DUMP TABLE

FIELD OF THE DISCLOSURE

The present disclosure is generally directed to product display fixtures and equipment and, more particularly, to a store lead-in fixture for a product dump table.

BACKGROUND OF THE DISCLOSURE

For many products, either product display shelves or product hanging projections have been used to support and display products in retail stores for selection by consumers. This is especially true of the many smaller products that are suitable for display, but are not generally self supporting. In addition, it is known to use what is generally referred to as a product dump table for visually displaying products in an attention drawing manner within a retail environment.

Product dump tables are typically formed to have a side wall that terminates in a top edge. The top edge of the side wall is adjacent a product receiving cavity in which products may be placed in quantity so as to be readily visually apparent to a customer walking through a retail store. But the side wall of the product dump table serves little purpose other than forming the product receiving cavity.

In most cases, product dump tables are placed in what is generally referred to as a power aisle. The power aisle is typically at the front of a retail store through which every customer must walk to proceed to other areas of the store where specifically targeted items for purchase are located. Thus, the power aisle is a heavy traffic location ideal for impulse purchases that greatly enhance profitability.

In the past, power aisle dump tables have been very successful in increasing impulse purchases by customers. The fact that essentially every customer of a retail store must pass by power aisle dump tables where such items will be visually displayed means that additional profits can be easily derived as a result of purchases that would not otherwise have been made by customers had such products not been presented to them in this manner. While power aisle dump tables are known profit generating equipment, the side walls of such tables have been wasted space.

In this connection, the power aisle dump tables are typically set up as an open top product display usually positioned in an "island" fashion which permits the customer to freely walk around them. Thus, while power aisle dump tables are highly functional, the side walls of these tables have not been used in any satisfactory manner to cause further profit generation within the retail environment.

For the foregoing reasons, there has been a need for a store lead-in fixture for a product dump table to maximize profit generation from such equipment.

SUMMARY OF THE DISCLOSURE

Accordingly, the present disclosure is directed to a store lead-in fixture for a product dump table having a side wall terminating in a top edge adjacent a product receiving cavity. The store lead-in fixture includes a support structure to be placed in confronting relation to the side wall of the product dump table, a mounting structure to be placed in operative association with the top edge of the product dump table, and a presentation structure for visually displaying product on the side wall of the product dump table. With this arrangement, the store lead-in fixture can readily be placed on and removed from a product dump table to provide for additional product display in a high traffic area of a retail store environment.

In another respect, the support structure preferably comprises at least a pair of generally vertical frame members disposed in spaced relation so as to be placed in contact with the side wall of the product dump table. The support structure advantageously further includes a generally horizontal frame member extending between and being integrally associated with each of the spaced generally vertical frame members. Further, each of the generally vertical frame members preferably has a top end and a bottom end with the generally horizontal frame member extending between and being integrally associated with the top ends.

In another respect, the mounting structure preferably comprises at least one hanger integrally associated with the support structure to hang the store lead-in fixture from the top edge of the product dump table. The hanger advantageously comprises an inverted U-shaped sleeve which is formed to receive the side wall at the top edge thereof in closely conforming relation to secure the store lead-in fixture in place on the product dump table. Still further, the sleeve is preferably integrally associated with the generally horizontal frame member which extends between and is integrally associated with the pair of generally vertical frame members.

In still another respect, the presentation structure includes at least one product display shelf operatively associated with the support structure to project outwardly of the side wall of the product dump table. The product display shelf of the presentation structure advantageously extends between and is operatively associated with the pair of spaced generally vertical frame members that comprise the support structure of the store lead-in fixture. Still further, the presentation structure preferably includes a pegboard surface mounted to the support structure together with at least one product hanging projection mounted to the pegboard surface.

In one embodiment, the store lead-in fixture is adapted to be removably associated with a power aisle dump table. The power aisle dump table is generally rectangular and has a continuous side wall defined by four generally perpendicular side wall portions. In this connection, the side wall portions terminate in a continuous top edge adjacent a rectangular product receiving cavity.

With this embodiment, the store lead-in fixture includes a pair of generally vertical frame members disposed in spaced relation to be placed in contact with one of the side wall portions. A hanger is integrally associated with a generally horizontal frame member for hanging the store lead-in fixture from the top edge of the power aisle dump table. The generally horizontal frame member is integrally associated with each of the generally vertical frame members adjacent the top edge of the power aisle dump table. A product display shelf is mounted on the generally vertical frame members to visually display product on the one of the side wall portions of the power aisle dump table. Also, the store lead-in fixture includes a product hanging projection vertically disposed above the product display shelf to visually display product on the one of the side wall portions.

With this arrangement, the store lead-in fixture also may include an end panel projecting outwardly of each of the generally vertical frame members in a direction away from the side wall portion of the power aisle dump table.

Preferably, the store lead-in fixture includes a pair of hangers each comprising a sleeve formed to receive the side wall at the top edge thereof in closely conforming relation to secure it in place on the power aisle dump table. Also, the store lead-in fixture advantageously includes a plurality of product display shelves and a plurality of product hanging projections removably and adjustably mounted to project outwardly of the one of the side wall portions of the power aisle dump table. The store lead-in fixture further advantageously includes a pegboard surface extending between and mounted to the generally vertical frame members together with a plurality of product hanging projections removably and adjustably mounted thereon. Still additionally, the product display shelves are preferably outwardly and downwardly inclined and each include a product-retaining lip extending along an outer most edge to visually display and retain product placed thereon.

Other objects, advantages and features of the present disclosure will become apparent from a consideration of the following specification taken in conjunction with the accompanying drawings.

DETAILED DESCRIPTION OF THE DRAWINGS

Figure 1:
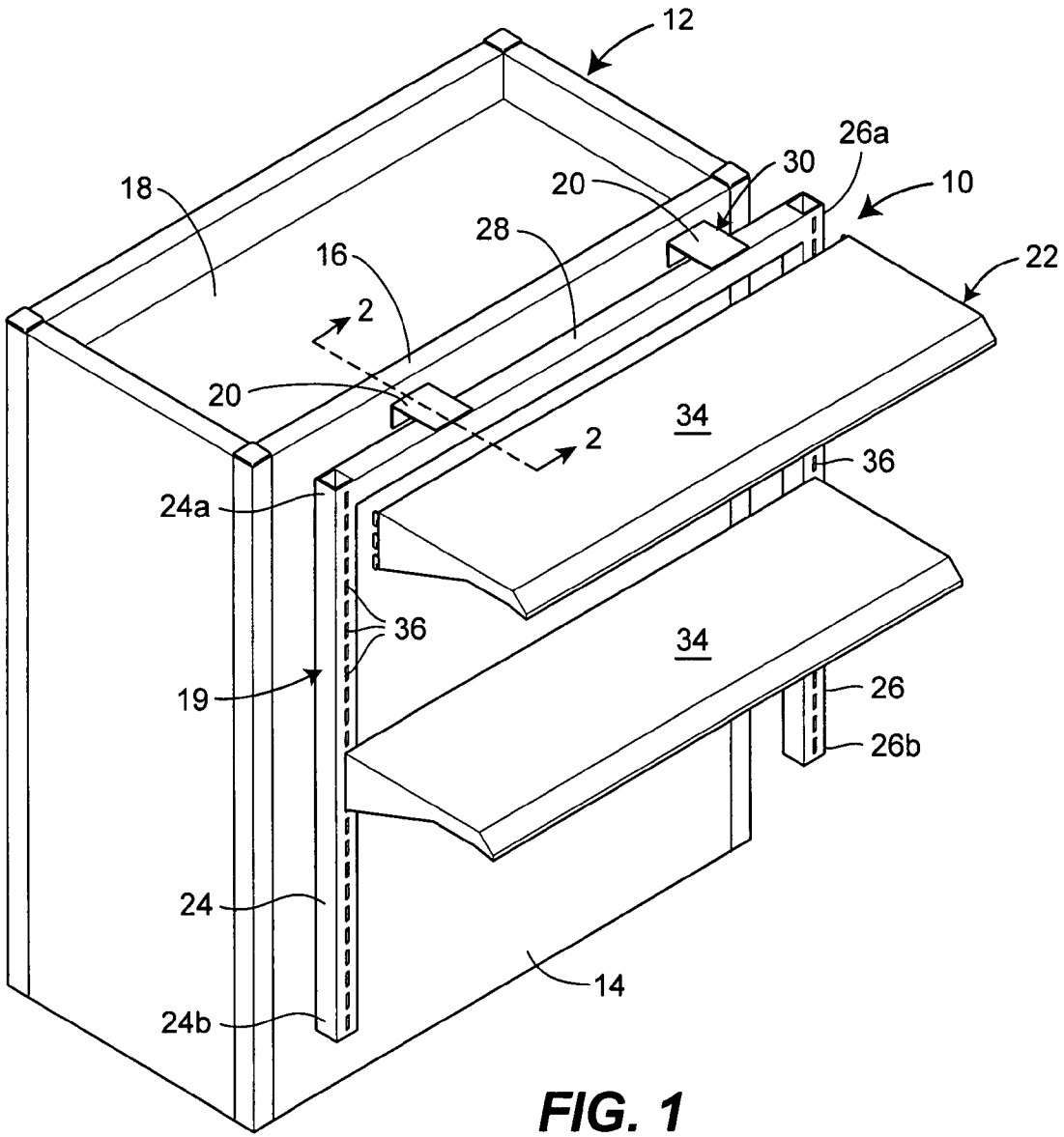
FIG. 1 is a perspective view of a store lead-in fixture and a product dump table in accordance with the present disclosure.

In the illustrations given, and with reference first to FIG. 1, the reference numeral 10 designates generally a store lead-in fixture for a product dump table 12. The product dump table 12 will be seen to have a side wall 14 which terminates in a top edge 16 generally adjacent to a product receiving cavity 18 in which products may be suitably displayed. The store lead-in fixture 10 comprises a support structure 19 to be placed in confronting relation to the side wall 14 of the product dump table 12. The store lead-in fixture also includes a mounting structure 30 to be placed in operative association with the top edge 16 of the product dump table 12 for easily removable placement thereon. The store lead-in fixture 10 includes a presentation structure 22 for visually displaying product on the side wall 14 as well as in the product receiving cavity of the product dump table 12. With this arrangement, the store lead-in fixture 10 can be placed on and removed from the product dump table 12 so products can be selectively displayed on the side wall 14.

The support structure 18 preferably includes at least a pair of generally vertical frame members 24 and 26 disposed in spaced relation to be placed in contact with the side wall 14 of the product dump table 12 (see FIG. 1). The support structure 18 further includes a generally horizontal frame member 28 extending between and being integrally associated with each of the spaced generally vertical frame members 24 and 26. As shown, the generally vertical frame members 24, 26 each have a top end 24*a*, 26*a* and bottom ends 24*b*, 26*b* and the generally horizontal frame member 28 extends between and is integrally associated with the top ends 24*a*, 26*a*.

Figure 2:
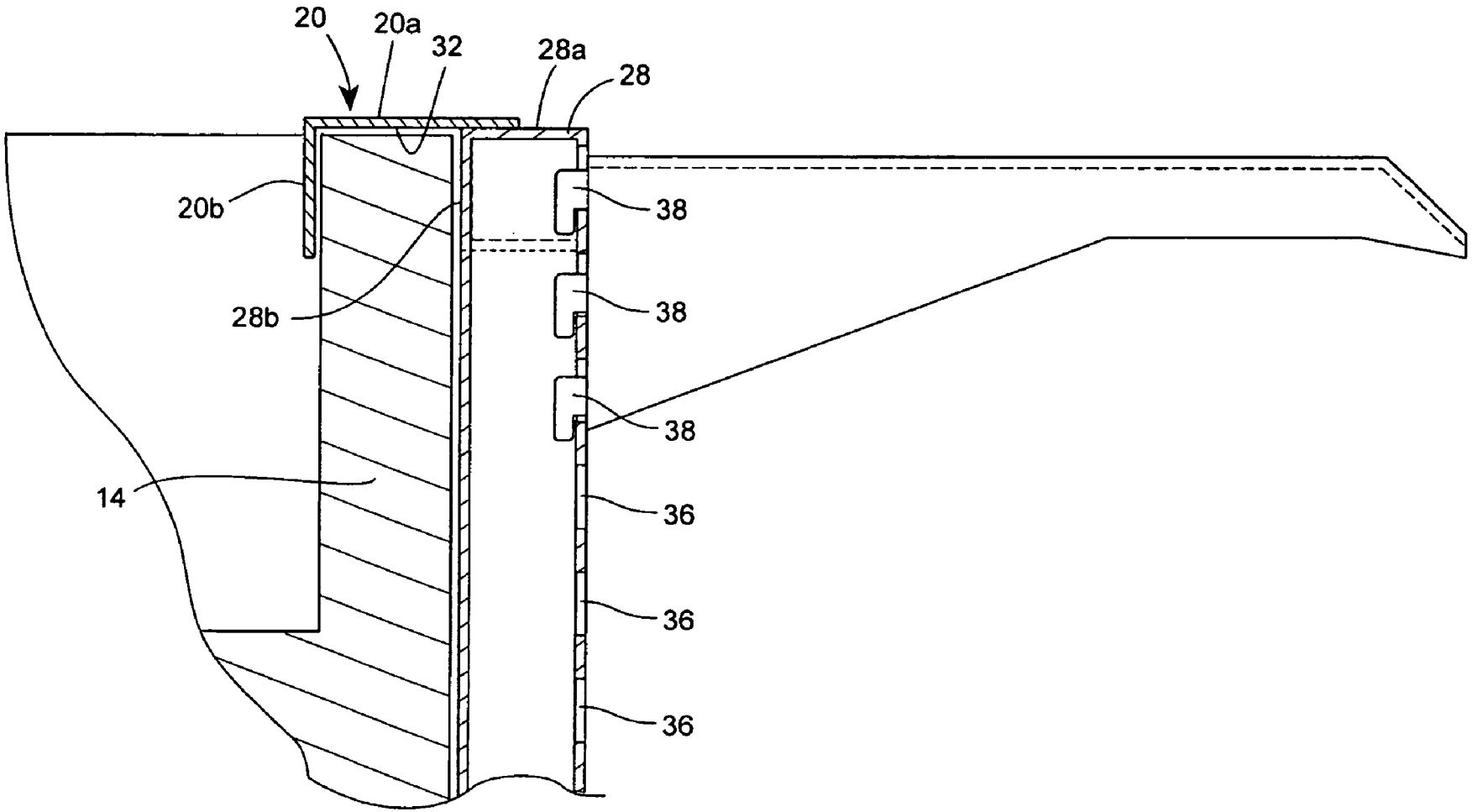
FIG. 2 is a cross-sectional view taken generally on the line 2-2 of FIG. 1, but having the store lead-in fixture mounted to the product dump table.

Referring to FIGS. 1 and 2, the mounting structure 30 includes at least one hanger 20 integrally associated with the support structure 18 to hang the store lead-in fixture 10 from the top edge 16 of the product dump table 12. Each hanger 20, as shown in FIG. 2, comprises a sleeve 32 formed to receive the top edge 16 of the side wall 14 in closely conforming relation to secure the store lead-in fixture 10 in place on the product dump table 12. As shown in FIG. 2, the sleeve 32 is defined by the hangers 20 and the generally horizontal frame member 28 extending between and integrally associated with the generally vertical frame members 24, 26.

In the embodiment illustrated in FIGS. 1 and 2, the mounting structure 30 comprises a pair of hangers 20, each formed of an L-shaped angle secured to the top surface 28*a* of the generally horizontal frame member 28 so that the sleeve 32 is defined by the two extending and mutually perpendicular legs 20*a*, 20*b* in cooperation with the side wall-facing surface 28*b* of the generally horizontal frame member 28.

Referring to FIG. 1, the presentation structure 22 may include at least one product display shelf 34 operatively associated with the support structure 18 to project outwardly of the side wall 14 of the product dump table 12. The store lead-in fixture 10 illustrated in FIG. 1 includes two product display shelves 34, each of which extends between and is operatively associated with the generally vertical frame members 24 and 26. By providing the generally vertical frame members 24, 26 with a repeating series of slots such as 36, the shelves 34 may be adjustably mounted on the frame members 24 and 26 by including conventional mounting structure thereon.

In this connection, it will be appreciated by those skilled in the art that such conventional mounting structure may comprise a plurality of rearwardly and downwardly extending projections 38 at each end of the shelves 34 that permit them to hang from the frame members 24 and 26 at any vertical position therealong.

Still referring to FIG. 1, the product dump table 12 which has been illustrated has a continuous side wall 14. The continuous side wall 14 may be comprised of four perpendicular side wall portions which together define a generally rectangular product dump table 12. With this configuration, the continuous side wall 14 terminates in a continuous top edge 16 adjacent the product receiving cavity 18.

Figure 3:
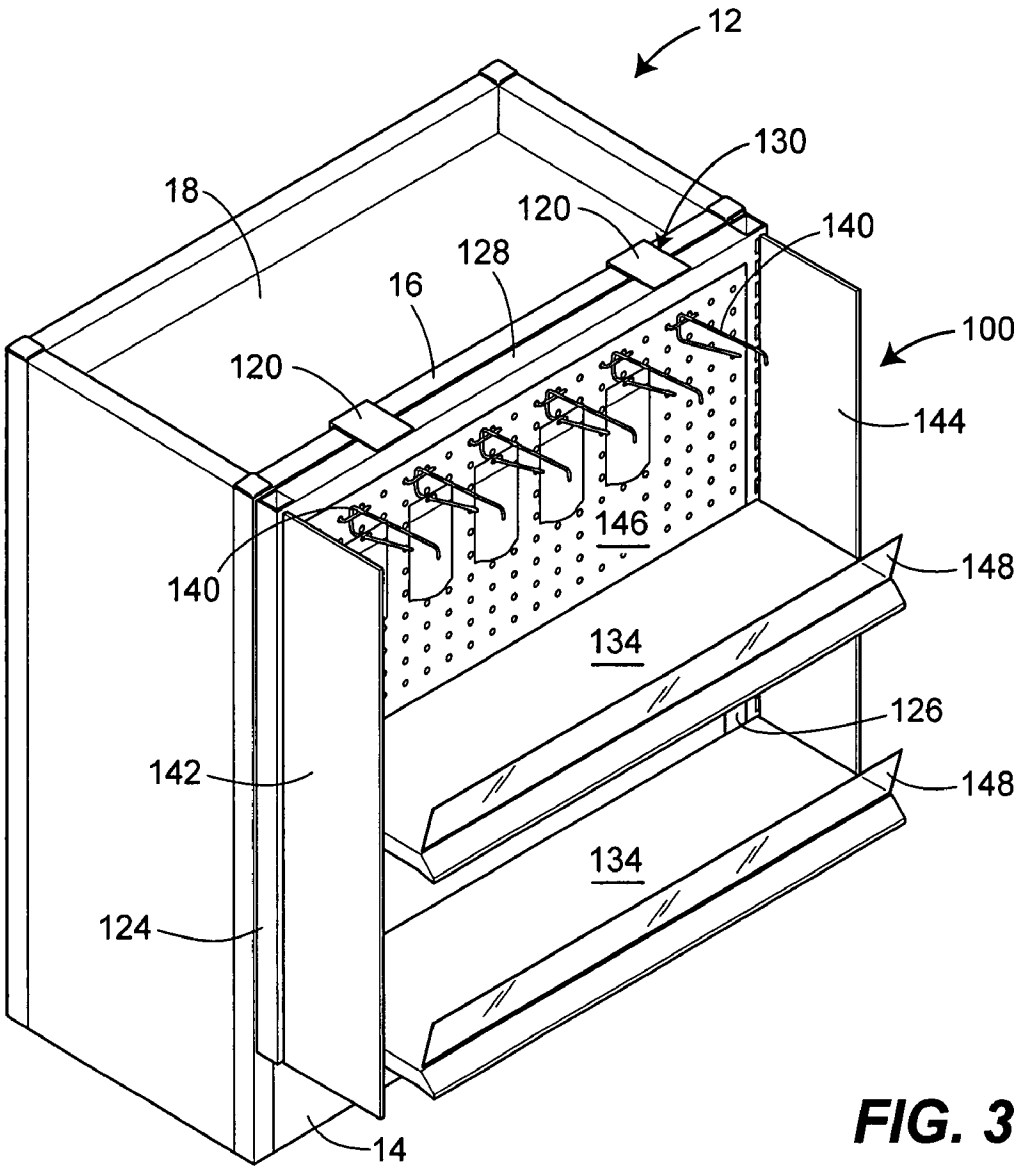
FIG. 3 is a perspective view of another store lead-in fixture and a product dump table in accordance with the present disclosure.

Referring now to FIG. 3, another embodiment of store lead-in fixture 100 for the product dump table 12 is illustrated. The product dump table 12 may be disposed in a power aisle of a retail store, in which case it will be understood to comprise a power aisle dump table. As shown, the power aisle dump table 12 is generally rectangular in shape as previously discussed in connection with FIG. 1.

More specifically, the power aisle dump table 12 of FIG. 3 has a continuous side wall 14. The continuous side wall 14 has four perpendicular side wall portions terminating in a continuous top edge 16. As in the embodiment of FIG. 1, the continuous top edge 16 is adjacent a rectangular product receiving cavity 18.

Referring to FIG. 3, the store lead-in fixture 100 includes a pair of generally vertical frame members 124 and 126 disposed in spaced relation to be placed in contact with one of the side wall portion of the power aisle dump table 12. A mounting structure 130 comprises a pair of hangers 120 integrally associated with a generally horizontal frame member 128 for hanging the store lead-in fixture 100 from the top edge 16 of the dump table 12. As in the embodiment illustrated in FIG. 1, the generally horizontal frame member 128 is preferably integrally associated with each of the generally vertical frame members 124, 126 adjacent the top edge 16 of the power aisle dump table 12.

Also, as in FIG. 1, one or more product display shelves 134 are mounted on the generally vertical frame members 124, 126 to visually display product on the one of the side wall portions of the power aisle dump table 12. However, unlike FIG. 1, the store lead-in fixture 100 includes at least one product hanging projection 140 vertically disposed above the product display shelf 134 to also visually display product. In addition, the store lead-in fixture 100 includes end panels 142 and 144 projecting outwardly of the generally vertical frame members 124, 126 and away from the one of the side wall portions of the power aisle dump table 12.

Preferably, in both embodiments illustrated in FIGS. 1 and 3, the store lead-in fixtures 10 and 100 include mounting structures 30, 130 comprising a pair of hangers 20 and 120, respectively, each hanger 20, 120 comprising an inverted U-shaped member defining a sleeve such as 32 formed to receive the side wall 14 at the top edge 16 thereof in closely conforming relation thereto. It will further be appreciated from a consideration of FIG. 3 that the store lead-in fixture 100 preferably includes a plurality of product display shelves 134 (as was also the case with the embodiment of FIG. 1) as well as a plurality of product hanging projections 140 which are all removably and adjustably mounted so as to project outwardly of the one of the side wall portions of the power aisle dump table 12. Advantageously, the store lead-in fixture 100 includes a pegboard surface 146 extending between and mounted to the generally vertical frame members 124, 126 in any conventional manner for removably and adjustably mounting the plurality of product hanging projections 140 thereon.

In addition to the foregoing, the product display shelves 134 may be removably and adjustably mounted on the generally vertical frame members 124 and 126 in the manner described in connection with the embodiment of FIG. 1 and, if desired, the product display shelves 134 can be outwardly and downwardly inclined and include a product-retaining lip 148 along an outer most edge which may be transparent to visually display and retain product placed thereon.

While preferred embodiments of the disclosure have been set forth in detail in the foregoing description, it will be appreciated that the details herein given may be varied by those skilled in the art without departing from the true spirit and scope of the appended claims.

What is claimed is:

1. A retail display apparatus, comprising:

a product dump table having a side wall terminating in a top edge adjacent a product receiving cavity;

a singular U-shaped support structure comprising a pair of generally vertical frame members and a generally horizontal frame member, the support structure placed in confronting relation to the side wall of the product dump table;

a mounting structure carried by the support structure, the mounting structure in engagement with the top edge of the product dump table; and a presentation structure for visually displaying product on the side wall of the product dump table.

2. The retail display apparatus of claim 1 wherein the vertical frame members are disposed in spaced relation.

3. The retail display apparatus of claim 2 wherein the generally horizontal frame member extends between and is integrally associated with each of the spaced generally vertical frame members.

4. The retail display apparatus of claim 3 wherein each of the generally vertical frame members has a top end and a bottom end and the generally horizontal frame member extends between and is integrally associated with the top ends.

5. The retail display apparatus of claim 1 wherein the mounting structure comprises at least one hanger integrally associated with the support structure.

6. The retail display apparatus of claim 5 wherein the hanger defines a sleeve receiving the top edge of the sidewall in closely conforming relation to secure the store lead-in fixture in place on the product dump table.

7. The retail display apparatus of claim 6 wherein the sleeve is further defined by the generally horizontal frame member extending between and integrally associated with the pair of generally vertical frame members.

8. The retail display apparatus of claim 5, wherein the at least one hanger is disposed between the pair of generally vertical frame members.

9. The retail display apparatus of claim 1 wherein the presentation structure includes at least one product display shelf operatively associated with the support structure and projecting outwardly of the side wall of the product dump table.

10. The retail display apparatus of claim 9 wherein the product display shelf of the presentation structure extends between and is operatively associated with the pair of generally vertical frame members of the support structure.

11. The store lead-in fixture of claim 10 wherein the presentation structure includes a pegboard surface mounted to the support structure together with at least one product hanging projection mounted to the pegboard surface.

12. A retail display apparatus, comprising:

a product dump table being generally rectangular and having a continuous side wall defined by four generally perpendicular side wall portions terminating in a continuous top edge adjacent a rectangular product receiving cavity;

a one-piece U-shaped support structure comprising a pair of generally vertical frame members and a generally horizontal frame member integrally associated with the vertical frame members, the vertical frame members disposed in spaced relation adjacent a first of the side wall portions of the product dump table, the generally horizontal frame member connected to each of the generally vertical frame members adjacent the top edge of the product dump table;

at least one hanger connected to the generally horizontal frame member, the hanger engaging the top edge of the product dump table to support the support structure; and a product display shelf mounted on the generally vertical frame members and adapted to visually display product on the first of the side wall portions of the product dump table.

13. The retail display apparatus of claim 12, wherein the hanger is disposed between the pair of generally vertical frame members.

* * * * *